United States Patent [19]

Epstein et al.

[11] 3,938,578

[45] Feb. 17, 1976

[54] METHOD FOR MAKING FOUNDRY MOULDS AND CORES UTILIZING A GAS CATALYST

[75] Inventors: David Epstein; Leslie A. Watkins; John W. J. Bugg, all of London, England

[73] Assignee: The White Sea & Baltic Company Limited, London, England

[22] Filed: Feb. 13, 1974

[21] Appl. No.: 442,302

[30] Foreign Application Priority Data

Feb. 20, 1973 United Kingdom ..... 8388/73

[52] U.S. Cl. ..... 164/16

[51] Int. Cl.[2] ..... B22C 9/12

[58] Field of Search ..... 164/16, 12; 117/5.1, 5.3

[56] References Cited

UNITED STATES PATENTS

| | | | |
|---|---|---|---|
| 2,313,672 | 3/1943 | Salzberg et al. | 117/5.2 |
| 2,521,839 | 9/1950 | Feagin | 117/5.2 |
| 3,008,205 | 11/1961 | Blaies, Jr. | 164/16 |
| 3,145,438 | 8/1964 | Kottke et al. | 164/16 |

OTHER PUBLICATIONS

"How to Use Phenolic Casting Resins for Pattern Coatings," By E. J. McAffee, American Foundryman, Vol. 17, No. 2, pp. 27–28, Feb. 1950.

*Primary Examiner*—Francis S. Husar
*Assistant Examiner*—John E. Roethel
*Attorney, Agent, or Firm*—Lawrence Rosen; E. Janet Berry

[57] ABSTRACT

Foundry moulds or cores are made by putting a mixture of foundry sand and acid-hardenable binder into a mould or core box, hardening the binder by passing an acidic gas through the mixture, removing the mould or core from the box and applying to its surface a material which will neutralise or adsorb acidic gases. The neutralising or adsorbent material permits avoidance of the health hazard of emission of acidic gas from the mould or core on storage or during use.

6 Claims, No Drawings

METHOD FOR MAKING FOUNDRY MOULDS AND CORES UTILIZING A GAS CATALYST

A variety of binders has been used for binding together particles of foundry sand in making foundry moulds and cores and a variety of catalysts has been used to set the binders. Gaseous catalysts have been proposed for use with organic binders in U.S. specification No. 3,145,438 and would have certain advantages; when these are used the mixture of sand and binder would be put into the core or mould box and the gaseous catalyst then passed through the mixture. The gaseous catalysts suitable for use with organic binders are strongly acidic gases e.g. hydrogen chloride.

According to the present invention a foundry mould or core is made by a method comprising putting a mixture of foundry sand and a binder hardenable by use of an acidic catalyst into a core or mould box, passing an acidic gas through the mixture thereby causing the binder to harden, removing the core or mould from the box and applying to the surface of the core or mould a composition comprising a material which will neutralise acidic gases or which will adsorb such gases.

In U.S. specification No. 3,145,438 the gaseous acidic catalysts would have had the disadvantage of giving rise to serious health and corrosion hazards since, on casting, the temperature of the liquid metal would result in rapid discharge of gaseous catalyst trapped in the core or mould. Also, we have found that even under normal ambient conditions, acidic gas tends to volatilise from the gassed core or mould once it is removed from the box.

The acidic gases set the binders catalytically and the amount of gas theoretically required to lower the pH sufficiently for adequate setting is very small. In practice however since the binder is, before setting, dispersed as a very thin liquid layer amongst a large volume of sand particles, more gas is required than the theoretical amount to produce a given lowering of the pH of the binder. The amount of gas required in practice can however readily be determined by simple experiments. The amount of gas used may be controlled in practice by the time that a valve is opened that releases acidic gas from a container into the mixture in the box. Important factors influencing the amount of gas needed and thus the time that such a valve needs to be kept open are, for a particular gas, a particular binder and a particular ratio of binder to foundry sand, the pressure at which the gas is supplied to the box, the temperature, the size and shape of the core or mould and the permeability of the mixture in the box.

The introduction of the acidic gas into the mixture can be effected in various ways. Thus, the gas can simply be forced in at superatmospheric pressure from a container or can be supplied at substantially atmospheric pressure and drawn into the mixture by application of a vacuum to an outlet from the core or mould box. Either of these procedures can be modified by first supplying the acidic gas in such a manner that it does not initially spread throughout the mixture in the box and then supplying air, either under pressure or drawn in by application of a vacuum to an outlet from the box, to distribute the acidic gas throughout the mixture. This modification can be of value in ensuring uniform distribution of the acidic gas in the mixture without using more acidic gas than is needed for the hardening. The vacuum technique is of value since it avoids any risk, during the gassing procedure, of harmful acidic gas escaping into the atmosphere.

The particular gassing procedure used has, we have found, an effect on the amount of gas needed. Thus, we have found that, for example, in one particular case hydrogen chloride gas had to be supplied at a pressure of 20 lbs per square inch for 5 seconds in order to give complete hardening whereas if the gas were supplied at the same pressure for only 1½ to 2 seconds to a duplicate sample but air then supplied at 20 to 30 lbs per square inch for 3 seconds complete hardening again resulted. In such a test using hydrogen chloride gas followed by compressed air it was found that the gas sample contained 0.3% by weight of hydrogen chloride. The sample was left in the open at a temperature of 8°C and a relative humidity of 60% and was observed to emit hydrogen chloride gas for a period of 80 minutes as determined by litmus paper held 1 inch above the sample.

In the method according to the invention the hazards arising from the use of gaseous acidic catalysts are minimised in that, when acidic gases are discharged on or before, casting, these are neutralised or adsorbed, at least partly, by the neutralising or adsorbent material.

Suitable neutralising materials are usually inorganic materials such as metallic oxides, hydroxides e.g. of barium, calcium, sodium and potassium, carbonates e.g. of barium, calcium, sodium and potassium and certain silicates e.g. of sodium and potassium. These materials may be applied in solution or suspension and suitable solvents or suspending media include water, alcohols e.g. isopropyl alcohol and mixtures thereof.

With certain neutralising materials the gas may form a hygroscopic salt e.g. calcium chloride or sodium sulphite. This may be harmless if, for example, the core is to be used directly after being made and the mould is not made of green sand, i.e. a mixture comprising foundry sand, clay and a relatively high proportion of water. In cases where the presence of hygroscopic salts is undesirable their formation can be avoided by choice of an appropriate neutralising material e.g. potassium or barium hydroxide rather than calcium hydroxide when hydrogen chloride gas is used.

Instead of or in addition to a neutralising material an adsorbent material may be used. Active carbon and silica gel are suitable. These materials can be applied in suspension and suitable suspending media are as mentioned above for the neutralising materials. If a composition comprising both a neutralising material and an adsorbent material is used the former may be in suspension or solution whilst the latter is in suspension.

The amount of neutralising material and/or adsorbent material needed can readily be determined by simple experiment: as some of the acidic gas will remain in the interior of the core or mould even on casting, not all of the acidic gas present will need to be neutralised or adsorbed in order to prevent the health and corrosion hazards. As indicated above, the neutralising material and/or adsorbent material may be applied in the form of a liquid composition and this will usually contain 30 to 50% by weight of solids. The liquid compositions may be applied by spraying or painting or swabbing: in the case of spraying it is convenient to use more dilute suspensions or solutions than with other techniques of application of the compositions.

The liquid compositions applied desirably contain a resin soluble in an organic solvent e.g. an alcohol present in the composition. Suitable resins include ester resins and other resins used in the paint industry. We have found that the use of such resins is advantageous in that it increases the adherence of the materials applied to the surface of the core or mould: this advantage is particularly significant when the material applied includes an adsorbent material.

When the liquid compositions used comprise water it is desirable after application of the composition to apply heat to drive off some at least of the water. The heat can be applied by use of a torch or blow-lamp or by use of an oven positioned above the core or mould.

If the composition applied is a suspension it is generally desirable to include an anti-settling agent to impart stability to the suspension. Other materials may also be included in the compositions e.g. graphite or mineral blacking which behaves similarly to graphite.

The particular nature of the binder used in making cores or moulds in accordance with the invention is not of importance in the invention except insofar as the advantages only apply where the binder used is one conveniently hardenable by an acidic catalyst. Such binders are usually organic ones, a variety of resins being known for this purpose and being conveniently hardenable by acidic catalysts. Particularly satisfactory binders are resin condensates, e.g. a condensate, in oligomeric form, of formaldehyde with one or more of furfuryl alcohol, phenol and urea: some free furfuryl alcohol may also be present. Such binders are normally used in the form of aqueous compositions, e.g. solutions, containing from 1 to 30% by weight of water: they are usually employed in an amount of 1 to 5% by weight based on the weight of foundry sand, preferably from 1.2 to 2% by weight based on the weight of foundry sand.

The effect of binders of the type described above can be improved by the inclusion of a silane preferably of general formula $R'Si(OR)_3$ in which R' is a $C_2$–$C_6$ alkylene group bonded to an amino, epoxy, mercapto, hydroxy, hydroxy-$C_1$–$C_6$ alkylamino, amino-$C_1$–$C_6$ alkylamino, $C_2$–$C_6$ alkenyl or $C_2$–$C_6$ alkenyl carboxy group and the groups R may be the same or different and are selected from $C_1$–$C_6$ alkyl and $C_1$–$C_6$ alkoxy-substituted-$C_1$–$C_6$ alkyl. Desirably the amount of silane used is 0.05 to 0.5% by weight, preferably 0.1 to 0.2%, based on the weight of aqueous resin condensate composition.

Examples of suitable acidic gases which can be used in the method according to the invention are hydrogen chloride, sulphur dioxide and sulphur trioxide.

There are certain advantages in having the mixture of foundry sand and binder in fluid condition when it is put into the core or mould box. Conveniently this can be achieved by including with the mixture of foundry sand and binder a foaming agent and foaming the aqueous phase before this mixture is poured into the box. In order to provide sufficient aqueous phase for foaming of this to render the entire composition fluid some water may need to be added in addition to that normally present in the binder composition itself. The foaming agent will generally be used in an amount of 0.1 to 0.5% by weight based on the foundry sand. Suitable foaming agents include alkali metal organic sulphates and sulphonates.

The following are examples of compositions useful in the method according to the invention and the manner in which they are used.

EXAMPLE 1

| | |
|---|---|
| Mineral Blacking | 64 parts by weight |
| Calcium hydroxide (commercial grade) | 30 parts by weight |
| Resin | 5 parts by weight |
| Anti-settling agent | 1 part by weight |

The above components were formed into a suspension having a 40% by weight solids concentration in isopropyl alcohol. The resin used was an estertype resin soluble in isopropyl alcohol and the anti-settling agent used was CVP anti-settling agent (Cray Valley Company Limited).

EXAMPLE 2

| | |
|---|---|
| Mineral Blacking | 50 parts by weight |
| Precipitated calcium carbonate | 50 parts by weight |

The above components were formed into a suspension having a 50% by weight solids concentration in water. After application of such a composition the core or mould should be heated to remove at least the bulk of the water.

EXAMPLE 3

| | |
|---|---|
| Potassium hydroxide | 20 parts by weight |
| Barium hydroxide | 30 parts by weight |
| Active carbon | 5 parts by weight |
| Graphite | 40 parts by weight |
| Resin | 4.5 parts by weight |
| Anti-settling agent | 0.5 parts by weight |

The above components were formed into a suspension having a 35% by weight solids content in isopropyl alcohol. The resin and anti-settling agent were as in Example 1.

EXAMPLE 4

| | |
|---|---|
| Sodium silicate | 50 parts by weight |
| Mineral Blacking | 40 parts by weight |
| Water | 10 parts by weight |

The above components were formed into a suspension. The sodium silicate used was Crosfield 112 sodium silicate. The suspension was suitable as such for application or could be diluted with further water before application. If the water content were to be increased substantially the core or mould should subsequently be heated to remove at least most of the water.

EXAMPLE 5

| | |
|---|---|
| Mineral blacking | 64 |
| Barium Hydroxide | 30 |
| Resin | 5 |
| Antisettling agent | 1 |

The above components were formed into a suspension having a 35% by weight solids content in isopropyl alcohol. The resin and antisettling agent used were as in Example 1.

The term foundry sand is used throughout this specification to mean not only those inorganic aggregates commonly referred to as sand and useful in making foundry moulds and cores but also other aggregates of inorganic matter of natural or synthetic origin suitable for this purpose e.g. olivine, chromite and zircon.

We claim:

1. A method for making foundry moulds or cores comprising putting a mixture of foundry sand and a binder hardenable by use of an acidic catalyst into a mould or core box, passing an acidic gas through the mixture thereby causing the binder to harden, removing the mould or core from the box and applying to the surface of the mould or core a composition comprising a material which will neutralise acidic gases or which will adsorb such gases, said composition being applied in an amount effective to neutralise or adsorb at least a substantial proportion of the acidic gases released from the mould or core before and during casting.

2. The method according to claim 1 in which the binder is a resin condensate, in oligomeric form, of formaldehyde with one or more of furfuryl alcohol, phenol and urea.

3. The method according to claim 2 in which the resin condensate is used in the form of an aqueous composition containing from 1 to 30% by weight of water and is used in an amount of 1 to 5% by weight based on the weight of the foundry sand.

4. The method according to claim 1 in which the acidic gas is a gas selected from the group consisting of hydrogen chloride, sulphurdioxide and sulphurtrioxide.

5. The method according to claim 1 in which the composition applied to the surface of the mould or core includes a resin in solution in an organic solvent.

6. The method according to claim 1 in which the composition applied to the surface of the mould or core is a suspension containing an anti-settling agent.

* * * * *